United States Patent [19]

Naplatanov et al.

[11] 3,979,731

[45] Sept. 7, 1976

[54] METHOD OF AND SYSTEM FOR RATIONALIZING THE OPERATION OF OPEN-PIT MINES

[75] Inventors: Nicolay Delchev Naplatanov; Vasil Stoyanov Sgurov; Peter Anguelov Petrov; Zdravko Alexandrov Nicolov; Alexander Ivanov Ganchev; Stefan Petrov Trendafilov, all of Sofia, Bulgaria

[73] Assignee: Institute Po Technicheska Kibernetika pri Ban, Sofia, Bulgaria

[22] Filed: Feb. 11, 1975

[21] Appl. No.: 549,103

Related U.S. Application Data

[63] Continuation-in-part of Ser. No. 444,704, Feb. 22, 1974, abandoned, which is a continuation of Ser. No. 193,280, Oct. 28, 1971, abandoned.

[30] Foreign Application Priority Data

Oct. 29, 1970 Bulgaria ..... 15952

[52] U.S. Cl. ..... 340/172.5; 340/23

[51] Int. Cl.[2] ..... G06F 7/00

[58] Field of Search ..... 340/172.5, 22–24, 340/31, 38, 47–50; 445/1

[56] References Cited

UNITED STATES PATENTS

| | | | |
|---|---|---|---|
| 3,105,221 | 9/1963 | Schwarz | 340/31 R |
| 3,289,173 | 11/1966 | Smith | 340/172.5 |
| 3,568,161 | 3/1971 | Knickel | 340/172.5 |
| 3,610,159 | 10/1971 | Fichenscher | 340/172.5 X |
| 3,644,883 | 2/1972 | Borman et al. | 340/23 |

*Primary Examiner*—Harvey E. Springborn
*Attorney, Agent, or Firm*—Karl F. Ross; Herbert Dubno

[57] ABSTRACT

In an open-pit mine with several excavation sites and a fleet of trucks carrying ore from loading stations near these sites to a number of unloading stations, data concerning production schedules are manually fed into a programmer together with information on the yield of each loading station as determined by local ore analyzers, on the identity and location of vehicles as ascertained by roadside monitoring units, and on the loading and unloading rates as detected by sensing elements at the various stations. The programmer classifies the several loading stations in two groups, i.e. one group with a below-average content and another group with an above-average content of valuable material (ore) in the excavated mass, and determines the number of vehicles to be routed to the stations of either group on the basis of the ratios of unloaded ore and overburden to their respective production quotas, taking into account the number of vehicles waiting at the loading stations and the travel times of available vehicles to their assigned stations as displayed by a traffic simulator. Routing instructions are supplied to the drivers of empty vehicles by address boards located on the approaches to road junctions giving access to the various loading stations.

10 Claims, 7 Drawing Figures

METHOD OF AND SYSTEM FOR RATIONALIZING THE OPERATION OF OPEN-PIT MINES

CROSS-REFERENCE TO RELATED APPLICATIONS

This application is a continuation-in-part of our copending application Ser. No. 444,704, now abandoned, which was filed Feb. 22, 1974 as a continuation of our earlier and now abandoned application Ser. No. 193,280 filed Oct. 28, 1971.

FIELD OF THE INVENTION

Our present invention relates to a method of controlling a fleet of heavy-duty vehicles traveling between a plurality of material-handling stations in open-pit mines, and to a system for carrying out this method.

BACKGROUND OF THE INVENTION

In conventional open-cycle operation of such a system, with each vehicle circulating between a loading station and an unloading station assigned to it at the beginning of the shift, impaired efficiency may result from failure of the transport fleet to keep pace with production of a given excavator or from assignment of excessive numbers of vehicles to an associated loading station. This mode of operation therefore may prevent attainment of a given production quota. It is, furthermore, desirable that the traffic stream entering the loading and unloading stations be as uniform as possible to prevent local congestions.

In practice, however, it is very difficult in open-pit mines to determine and provide for an exact number of transporting vehicles required to meet the shift quota. Consideration must also be given to the need for maintaining a planned ratio of ore output to the inevitable production of overburden, as well as to possible changes in the number of available vehicles. Another important requirement is proper distribution of the ore according to the quality or grade thereof, bearing in mind the various processing facilities of the plant and the specifications of different consumers. Thus, for example, with widely scattered iron-ore deposits differing in their phosphorus content, predetermined fractions of the outputs of the several sites may have to be blended in order to obtain a homogenized commercial product of specific composition.

OBJECTS OF THE INVENTION

It is, therefore, an important object of our invention to provide a method of and a system for optimizing the performance of a fleet of heavy-duty vehicles traveling between a plurality of material-handling stations, more particularly between excavation sites and points of ore utilization in an open-pit mine.

It is another object of our invention to provide automatic traffic-control means in such a system for selecting the destinations of all vehicles on the basis of quality or kind of the materials to be transported.

SUMMARY OF THE INVENTION

As applied to an open-pit mine with a plurality of loading stations adjacent respective excavation sites and one or more unloading stations at respective processing sites, our invention provides for the rationalization of the operation of that mine by the following steps:

a. establishing production quotas for high-value and low-value constituents of the excavated material, specifically ore and overburden, during a predetermined operating period such as, for example, a day shift;

b. measuring during that operating period, at each excavation site, the relative proportions of high-value and low-value constituents of the excavated material;

c. classifying the loading stations, on the basis of these measurements, in a high-yield group and a low-yield group by comparing the quality of the excavated material with a standard, i.e. a predetermined ratio of ore and overburden consistent with the production schedule for that period;

d. continuously calculating, during this operating period, two progressively changing ratios, i.e. a first ratio representing the amount of produced ore in proportion to the ore-production quota and a second ratio representing the amount of produced overburden in proportion to the overburden-production quota;

e. comparing these first and second ratios with each other; and f. routing available transport vehicles, such as heavy-duty trucks, to the several loading stations on the basis of the aforementioned comparison, with preference given to the high-yield group of stations whenever the second ratio exceeds the first ratio and to the low-yield group of stations whenever the first ratio exceeds the second ratio.

If the mine comprises several processing sites and associated unloading stations, we prefer to perform step (d) individually for each unloading station while routing the vehicles to any unloading station from loading stations selected in accordance with step (f).

In elaborating the routing instructions, which advantageously are communicated visually to the drivers of empty vehicles with the aid of address boards at approaches to road junctions giving access to several loading stations, the number of vehicles waiting at each loading station of the preferred group should also be taken into account. Thus, we may initially select a loading station whose contribution to the overall output at the assigned unloading station would be most significant in bringing the ore/overburden ratio of that output back to the planned mean value; if, however, the number of vehicles already waiting at that initially selected loading station equals or possibly exceeds a predetermined maximum, another station of the group is to be chosen. In making that choice, consideration may also be given to the travel time of the vehicles from the loading to the unloading station inasmuch as the rate of material flow to a given unloading station is directly proportional to the number of vehicles headed for that station from any loading station (if these vehicles are of identical capacity) but inversely proportional to the transit time between the loading and unloading stations.

As a convenient way of simultaneously determining the number of waiting vehicles at each loading station as well as the flow density between specific loading and unloading stations, we prefer to use a traffic simulator visually indicating the motion of the various vehicles on the several access roads.

A system according to our invention includes a programmer designed to carry out automatically the aforementioned classifying, calculating and comparing steps (c), (d) and (e) and to elaborate routing instructions to be communicated to the drivers of empty vehicles with the aid of traffic-directing means controlled by the programmer, such as the address boards referred to. The programmer includes a memory for storing the origin and the destination of each vehicle as derived from the identification codes transmitted to it by the several monitoring units. From these stored data, and other information which may be fed in manually with the aid of a keyboard included in an input/output unit, the programmer can determine the number of circulating vehicles and the availability or nonavailability of any of them for the transport of additional material from a selected loading station to a particular unloading station. Certain vehicles, for example, may be permanently assigned to a specific course or may otherwise be incapable of serving as supplemental carriers for balancing the ore/overburden ratio at the unloading stations here considered.

Advantageously, the monitoring units positioned on the approaches to the loading stations include pairs of sensors respectively located upstream and downstream of an address board, the response of the upstream sensor to a passing vehicle triggering the programmer into the transmission to the address board of instructions for the driver of that vehicle whereupon the downstream sensor informs the programmer that the vehicle has moved beyond the board and the instruction may be canceled. Additional sensors may also be located at the entrance and exit of a home terminal to monitor the entry of vehicles into and the withdrawal of vehicles from the circulating fleet.

In such a system it is possible, for example, to deliver ore of a certain phosphorus content from one set of loading stations to one unloading station and ore of a different phosphorus content from another set of loading stations to another unloading station, the maintenance, of a substantially constant ore/overburden ratio at each unloading station insuring that a blending of equal or proportional amounts of material from the two unloading stations results in a desired phosphorus content of the mixture. In that case, of course, each set of loading stations associated with a particular unloading station would have to be subdivided into a high-yield and a low-yield group as described above. On the other hand, the terms "high-value constituent" and "low-value constituent" could also be applied to ore fractions rich and poor in phosphorus, for instance, with "value" used only in a relative sense in conjunction with a given purpose.

BRIEF DESCRIPTION OF THE DRAWING

The above and other features of our invention will now be described in detail with reference to the accompanying drawing in which.

SPECIFIC DESCRIPTION

Figure 1:
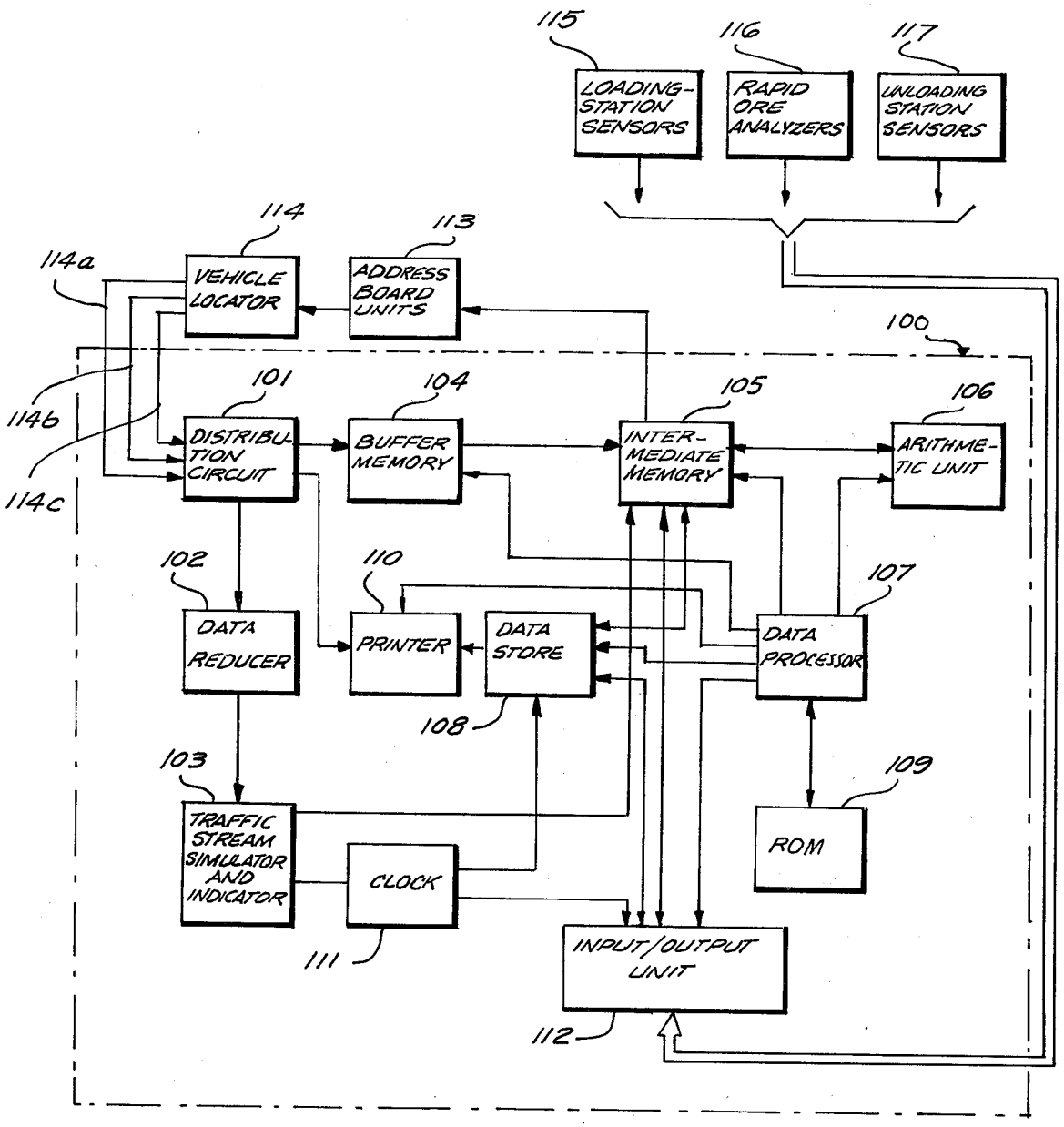
FIG. 1 is a block diagram of an overall traffic-control system embodying our invention.

FIG. 1 shows an overall block diagram of a traffic-control system according to our invention in which a programmer 100 handles information determining the routing of the vehicles. This programmer includes a distribution circuit 101 connected via a data reducer 102 to a traffic-stream simulator and indicator 103, wherefrom information passes to an intermediate memory 105 which stores pertinent data to be acted upon subsequently for traffic-control purposes. Intermediate memory 105 feeds a plurality of address-board units 113 located at various distribution centers for the vehicles of a transport fleet to be controlled.

Distribution circuit 101 also works into a buffer memory 104 and a printer 110. Upon a signal from a date processor 107, which generates a fixed program from information contained in a read-only memory 109, information is transferred from buffer memory 104 to intermediate memory 105 which is connected bidirectionally to an arithmetic unit 106 controlled by processor 107.

The information fed into programmer 100 is collected by a plurality of sensing elements 115 installed on loading equipment operating at several loading stations, next to respective excavators, to detect stoppages and thus to provide information on a change in the output that can be expected from a particular loader. Further sensing elements 117 are installed at unloading stations to detect changes in the arrival rate of oncoming material. Furthermore, a number of testing stations provided with rapid ore analyzers 116 are located in the vicinity of the several loading stations to keep track of the quality of the loaded materials. The output signals of the sensing elements 115 and 117, and the data obtained by rapid ore analyzers 116, are transmitted to an input/output unit 112 or programmer 100. The information-gathering system further includes a plurality of vehicle locators 114 distributed along the routes linking the several loading and unloading stations to one another, these locators serving to monitor the movements of empty or loaded trucks towards the several loading and unloading stations. The coded information relayed to programmer 100 from vehicle locators 114, indicating the identity and position of any vehicle in service, enters the distribution circuit 101. Programmer 100 operates in the following fashion:

Relevant information from the output of distribution circuit 101 is sorted out by data reducer 102 for control of traffic simulator 103. Reducer 102 may be a simple parallel-to-series converter, or a differentiator designed to transmit only changes of the signals received at its input. Simulator 103, in addition to providing visualization of the traffic patterns, presents information about the vehicles waiting near every excavator, as required for proper routing. The information passing from distributor 101 is immediately printed at stage 110 together with an accompanying time indication from a clock 111 and other data termporarily stored in a register 108.

Part of the information transferred from buffer memory 104 to intermediate memory 105 continues on to units 106 and 107 for further processing. Raw and processed data from units 105, 107 and 112 enter the register 108 and are delivered to printer 110 in response to a given signal from unit 107. Register 108 retains the total information related to excavator and dump-truck outputs, vehicle service, routing errors and the like.

Input/output unit 112 accepts operational inputs of target figures and constants from processor 107 and also relays information therefrom to dispatch controllers; this feature serves as a check of the functional and informational reliability of the overall system.

Figure 2:
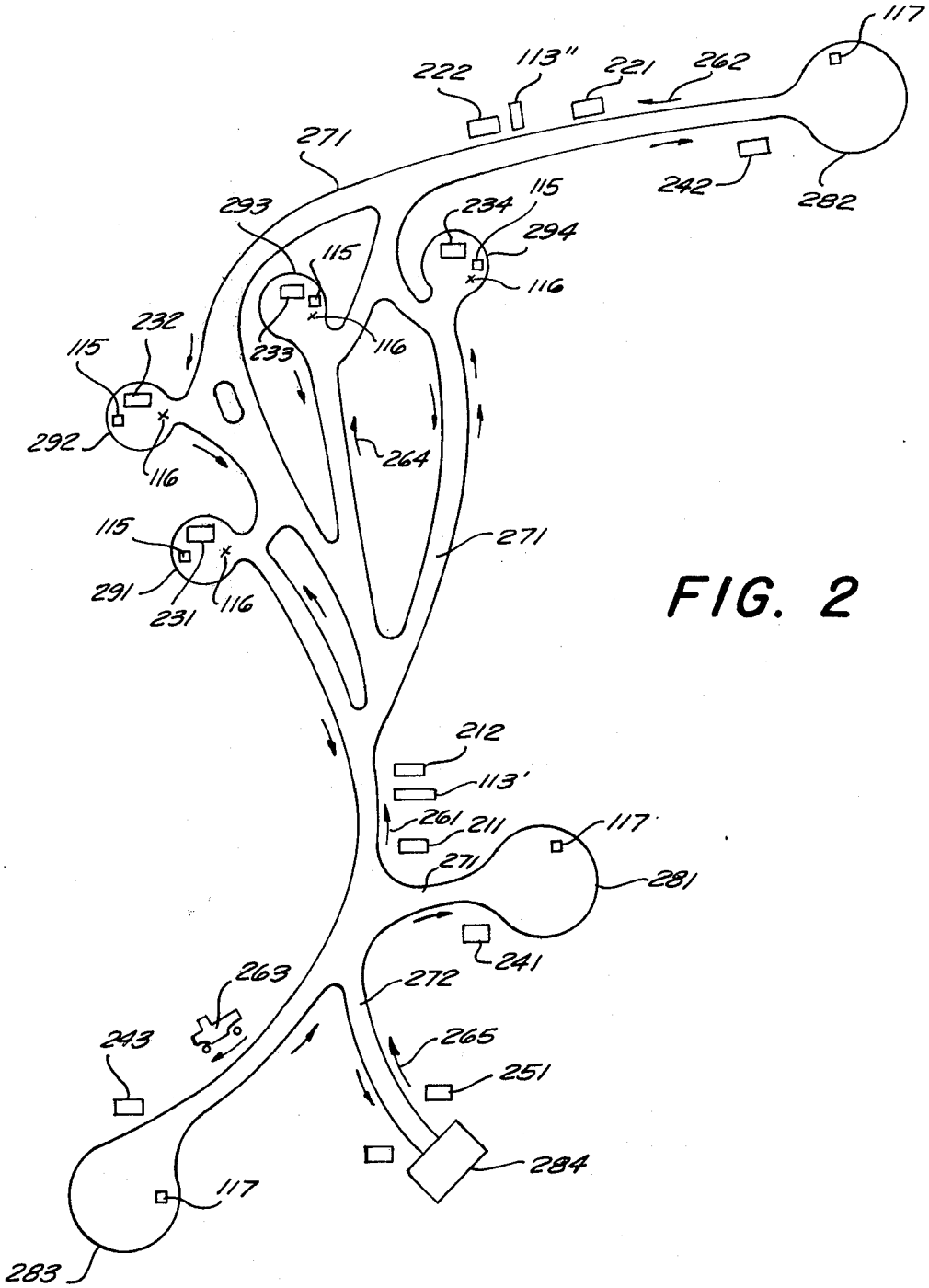
FIG. 2 is a route map of an open-pit mine served by the traffic-control system of FIG. 1.

FIG. 2 is a route map of an open-pit mine served by the system shown in FIG. 1. A number of trucks 261, 262, 263, 264 and 265, some of them indicated only schematically by arrows, represent a fleet of heavy-duty vehicles traveling over routes 271 between unloading stations 281–283 and loading stations 291–294 in the vicinity of respective excavation sites. Vehicle 265 is shown traveling on a road 272 to a home terminal 284. Every vehicle carries a ratio transmitted with an antenna array mounted on its right-hand side as viewed in the direction of travel. The transmitter continuously radiates a coded signal unique to each vehicle, identifying same. Sensors 211, 212, 221, 222, 231 – 234 and 241 – 243 forming part of the locator equipment 114 of FIG. 1 are disposed at preselected locations through which vehicles 261 to 265 are to pass or in front of which they have to stop. In the mine layout shown in FIG. 2, pairs of sensors 211, 212 and 221, 222 are installed along different sections of route 271. Single sensors 231, 232, 233 and 234 are located at loading stations 291, 292, 293 and 294, respectively. Additional single sensors 241, 242 and 243 are installed near unloading stations 281, 282 and 283, respectively. In the example shown, the overburden is discharged at unloading stations 282 and 283 while the commercial product is hauled to unloading station 281. Moreover, a pair of sensors 251, 252 are disposed on opposite sides of road 272 near home terminal 284. Ore analyzers 116 and sensing elements 115, 117 at loading and unloading stations have also been indicated.

The paired sensors 211, 212, and 221, 222 are installed just ahead of respective road junctions giving access to the several loading stations 291 – 294 on the right-hand side of the route as seen by a driver traveling toward the loading stations; single sensors 241, 242 and 243 are located on the approaches of unloading stations 281, 282 and 283, respectively, on the right-hand side of the route as seen by a driver traveling toward the unloading stations. The mounting of the vehicular antennas on the driver's right-hand side, proximal to any sensor passed, is a precautionary measure taken to avoid as much as possible simultaneous reception of transmissions from two vehicles moving in opposite directions past the location of a particular sensor. A similar problem is created when a group of closely bunched vehicles moves slowly past a sensor. Simultaneous reception of coded signals from more than one vehicle would result in a failure to record data for any of the vehicles. If the geometrical disposition of the antenna array alone does not solve this problem, other preventive measure must be used such as, for example, providing the system with a unit for rejecting any signal containing less or more than a prescribed number of identification-code digits.

Apart from the vehicle's identification code, a further coded signal is generated by every sensor to specify its position, thereby locating each vehicle on the basis of the last sensor to receive that vehicle's code. Both coded signals are transmitted to the central vehicle-dispatch office in which programmer 100 (FIG. 1) is installed, usng telephone lines or radio links.

FIG. 2 also shows two address-board units 113′ and 113″ designed to advise each driver of the destination currently assigned to his vehicle, as by visually displaying the vehicular code together with an identification of the loading or unloading station to be reached. Units 113′ and 114″ are disposed between sensor pairs 211, 212 and 221, 222, respectively. As shown for a generic address-board unit 113 in FIG. 1, these units are driven by signals received from memory 105 of programmer 100 and feed back their information to distribution circuit 101 thereof for providing a check on a possible error.

We shall now describe, with reference to FIGS. 3 – 7, specific details of certain components of the system of FIG. 1 together with their mode of operation in performing the several steps of the traffic-directing method according to our invention. In the following description the hundreds digits of reference numerals above 300 generally indicate the Figures in which the corresponding elements can be found.

MONITORING OF LOADING OPERATIONS AND ORE QUALITY

The output signals of the sensing element 115 and the data obtained from ore analyzers 116 at each loading station are transmitted to the dispatcher who feeds all the information into the intermediate memory 105 of programmer 100 by means of a hand-operated keyboard 504 (FIG. 5) of input/output unit 112.

An encoder 503 converts the input data into binary code words which are stored in an information register of intermediate memory 105 via a buffer register 502 working into a bus 501. The coded format is passed to bus 501 upon reception of an enabling signal which appears in the output of an AND-gate 505 upon the coincidence of two input signals applied thereto. The first input signal, corresponding to a specific mode of operation of keyboard 504, is generated by a decoder 506 in response to the setting of certain flip-flops in a storage network 507; the second input signal is provided by a decoder 515 upon the setting of certain flip-flops in a storage network 514 by decoder 506 and output leads 535 of processor 107 indicating their readiness to load the intermediate memory 105. At the same time, via bus 501, decoder 515 also energizes a lead 509 enabling the transfer of the contents of buffer register 502 into the information register of intermediate memory 105.

By means of keyboard 504 the operator sends a cell address to the intermediate memory 105 and emits a write command for inscribing same in the address register of that memory. The cell address is entered in buffer register 502 via encoder 503. The write command sets a combination of flip-flops in network 507, causing decoder 506 to energize one input of AND-gate 505 whose other input is energized by decoder 515 in response to the consent signal stored in network 514. In the presence of this consent signal, decoder 515 also energizes a lead 510 which enables the transfer of the cell address from buffer register 502 to the address register of the intermediate memory 105 via bus 501. Thus, the information on conditions encountered at the loading stations is now stored in the intermediate memory 105. The data concerning the quality of the loaded material are used for classifying the loading stations into groups with regard to the composition of that material. In the case of an open-pit mine, the ore is analyzed with regard to its grade and the stations are divided into two main groups, i.e. a first group yielding ore of at least minimum quality and a second group producing overburden.

Figure 7:
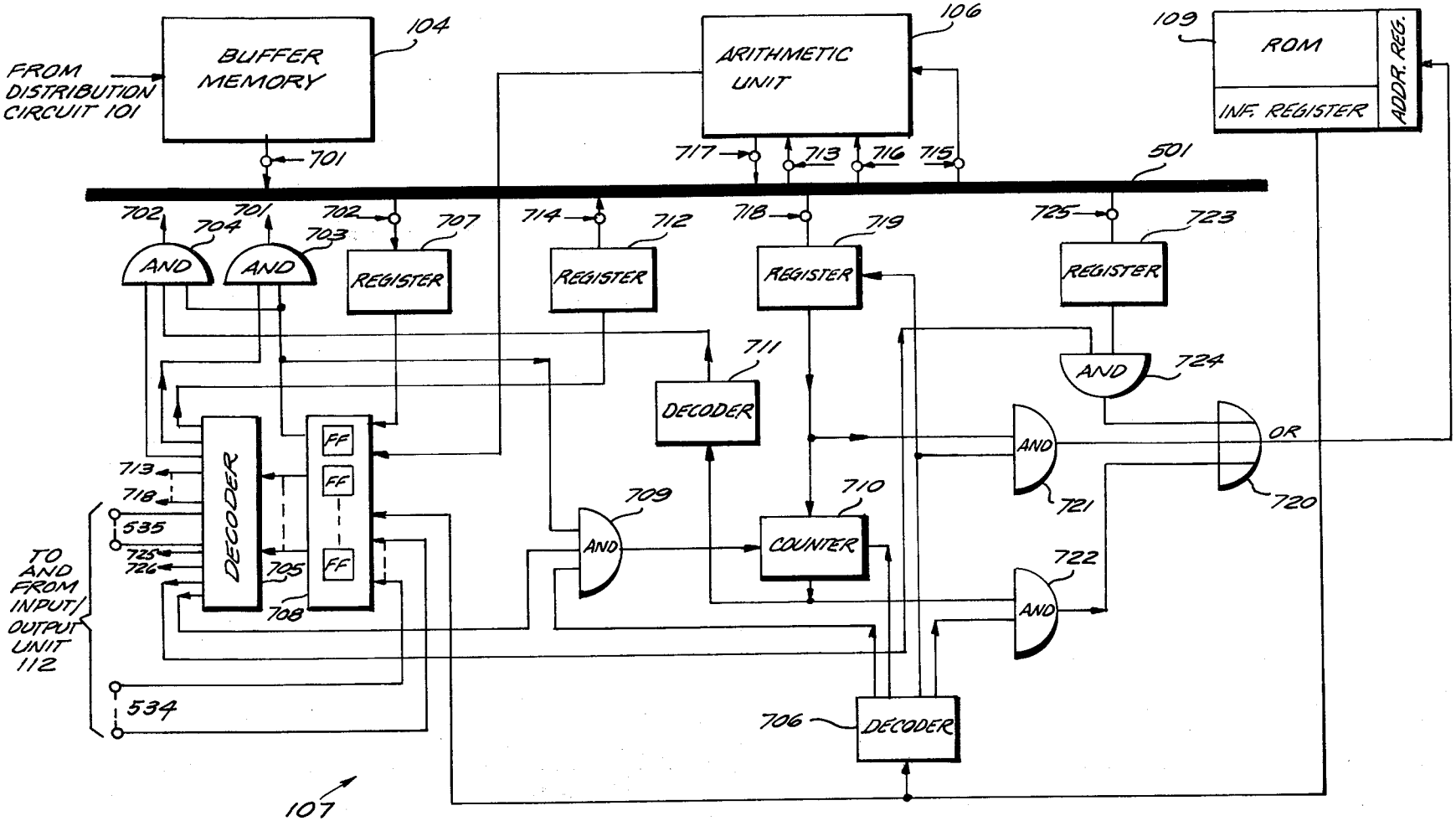
FIG. 7 is a diagram of a data processor shown in FIG. 1.

This grouping of the loading stations is accomplished after a comparison of thresholds inscribed in read-only memory (ROM) 109 with the values stored in the intermediate memory 105. The classifying operation is called forth by the operator through keyboard 504. It is coded 503 and entered in the buffer register 502 as an address of a designated cell of the ROM 109. Simultaneously, the setting of selected flip-flops in network 507 under the control of keyboard 504 results in the energization of one input of AND-gate 505, leads 534 extending to processor 107 and other leads terminating at network 514. As shown in FIG. 7, leads 534 extend to the input of a storage network 708 which in turn feeds a decoder 705. The latter, via bus 501 and a lead 718, loads a register 719 and transmits a confirmation signal over leads 535 to network 514 which, if in agreement with the signals from decoder 506, causes the decoder 515 to consent to the transfer of data to memory 105 by opening the AND-gate 505. The code of the classifying operation is stored in register 719 and, via an AND-gate 721 and an OR-gate 720, identifies a cell in an address register of ROM 109 which starts the classification cycle. Before the classification operation is initiated by the operator through keyboard 504, a counter 710 is set to zero, this condition being maintained by a decoder 706 responding to a zero-address instruction from ROM 109. The output signals of decoder 706 due to that instruction inhibit the passage of clock pulses through an AND-gate 709 and also block an AND-gate 722 but open the AND-gate 721 so that the contents of register 719 can read the address register of ROM 109 through OR-gate 720. The resulting coded command issuing from the information register of ROM 109 is read by decoder 706 which thereupon allows a loading of counter 710 with the instruction transmitted to ROM 109 from register 719. Decoder 706 now enables the setting of counter 710 to be communicated through AND-gate 722 and OR-gate 720 to the address register of ROM 109 and, at the same time, permits the passage of clock pulses to a stepping input of the counter by way of AND-gate 709 which alone receives an enabling signal from decoder 705. Furthermore, decoder 706 now blocks the AND-gate 721, to isolate ROM 109 from register 719, and stops the counter 710 from responding to output signals from register 719.

The instruction from the designated cell of ROM 109 is entered in buffer register 708 and translated by decoder 705 into the aforementioned enabling signal for the passage of clock pulses through AND-gate 709 to the stepping input of counter 710. Moreover, decoder 705 generates output signals on leads 535 which together with output signals from decoder 506, determined by the classification operation as set up through the keyboard 504, feed storage network 514 associated with decoder 515 so that the latter now blocks the AND-gate 505, thereby preventing the contents of buffer register 505 from reaching the bus 501. Furthermore, decoder 515 energizes the lead 510 facilitating the transfer of data to the address register of intermediate memory 105 via bus 501. Also, the instructions stored in network 705 include a code identifying a cell address in intermediate memory 105 allocated to a predetermined threshold value for the minimum acceptable grade of the material to be transported, this address being written into a register 712. Network 708, in response to energization of certain leads, emits a timing pulse, synchronized with the output of clock 111 working into network 507, to step the counter 710 via AND-gate 709 as described above. This calls forth from ROM 109 a new instruction containing information on the aforementioned threshold value, to be stored in network 708 and transferred by decoder 705 to register 712; a concurrent enabling signal from decoder 705 on a lead 714 authorizes the read-out of the contents of register 712 to bus 501. A combination of signals on certain output leads 535 of decoder 705 causes the decoder 515, associated with storage network 514, to energize a lead 509 allowing the entry of the contents of register 712 into the information register of intermediate memory 105, via bus 501. The output signals of decoder 506 do not affect the output signals of decoder 515, and manipulation of the keyboard 504 does not interfere with the classification operation. The enabling signal for AND-gate 709 is now continuously generated by decoder 705, this signal allowing the clock pulses to step the counter 710. Thus, the next pulse of clock 111 brings forth the address of the next instruction in ROM 109 which is supplied from the information register thereof to storage network 708. At this point, decoder 705 delivers to register 712 the address of a cell of the intermediate memory 105 in which data dealing with the quality of the material at the first loading station, i.e. the percentage of valuable contents thereof, are stored. The combination of signals now appearing on output leads 535 switches the network 514 so that decoder 515 energizes the lead 510 enabling transfer of the contents of register 712 into the address register of intermediate memory 105 via bus 501.

The next pulse of clock 111 advances counter 710 by another step, thus calling forth the next instruction from ROM 109. This instruction causes a selective energization of leads 535 giving rise to a signal on an output lead 508 of decoder 515 allowing the transfer via bus 501 of the contents of the information register of memory 105 to a register of arithmetic unit 106 which is concurrently made receptive by a signal on an output lead 716 of decoder 705. Unit 106, therefore, now contains data on the composition of the ore being loaded at the station under consideration, e.g. loading station 291 of FIG. 2.

Counter 710 is advanced by another step with the next pulse from clock 111 and consequently another instruction from ROM 109 is called forth by a command passed through gates 722 and 720. That instruction again loads the register 712 with the cell address of intermediate memory 105 in which the threshold value for the material to be transported has been entered. Leads 714 and 510 are energized anew in this cycle.

The following clock pulse causes the reading of a further instruction from ROM 109, that instruction prompting the energization of leads 713 and 508 allowing the transfer of the threshold value to a second register of arithmetic unit 106.

The next clock pulse calls forth an instruction from ROM 109 resulting in the loading of register 712 with a command for performance of the comparison operation in arithmetic unit 106. The energization of leads 714 and 715 allows the entry of that command from register 712 into a third register of unit 106. At the same time, decoder 705 blocks the passage of clock pulses to the stepping input of counter 710 by de-energizing one of the inputs of AND-gate 709.

Arithmetic unit 106 now carries out a cycle of comparison to determine whether the percentage of valuable contents attains or falls short of the operations threshold. The comparision result is added in coded form to the code combination already stored in network 708, i.e. the last instruction from ROM 109, thereby generating in the output of decoder 705 and transmitting to register 712 the address of a cell of intermediate memory 105 in which the code of the first loading station and the comparison result are to be stored. Then the counter 710 is advanced and a new instruction is read from ROM 109 with energization of leads 510 and 714 to transfer that address from register 712 to the intermediate memory via bus 501.

Figure 5:
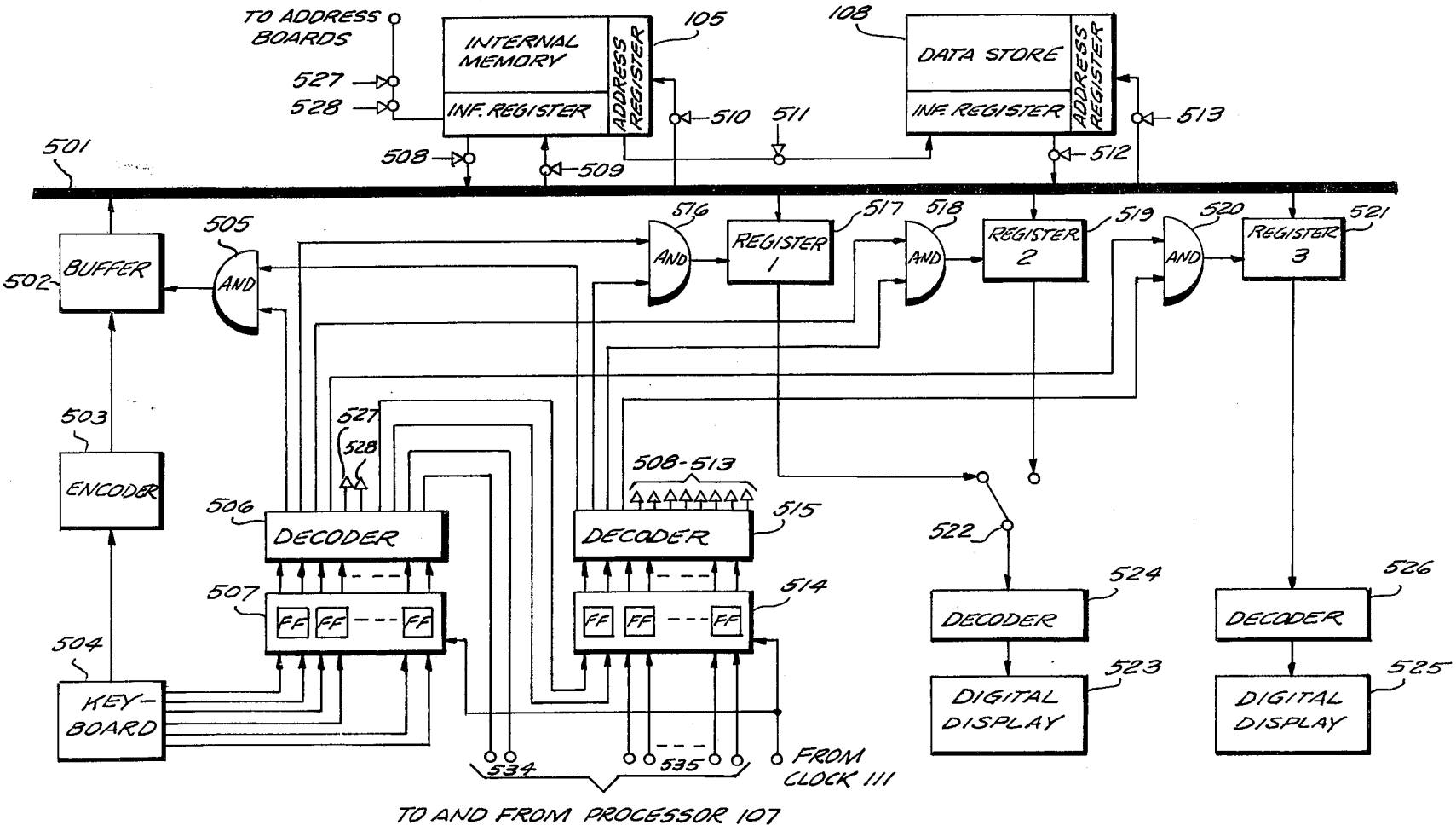
FIG. 5 is a diagram of a data input/output unit included in the system of FIG. 1.
Figure 6:
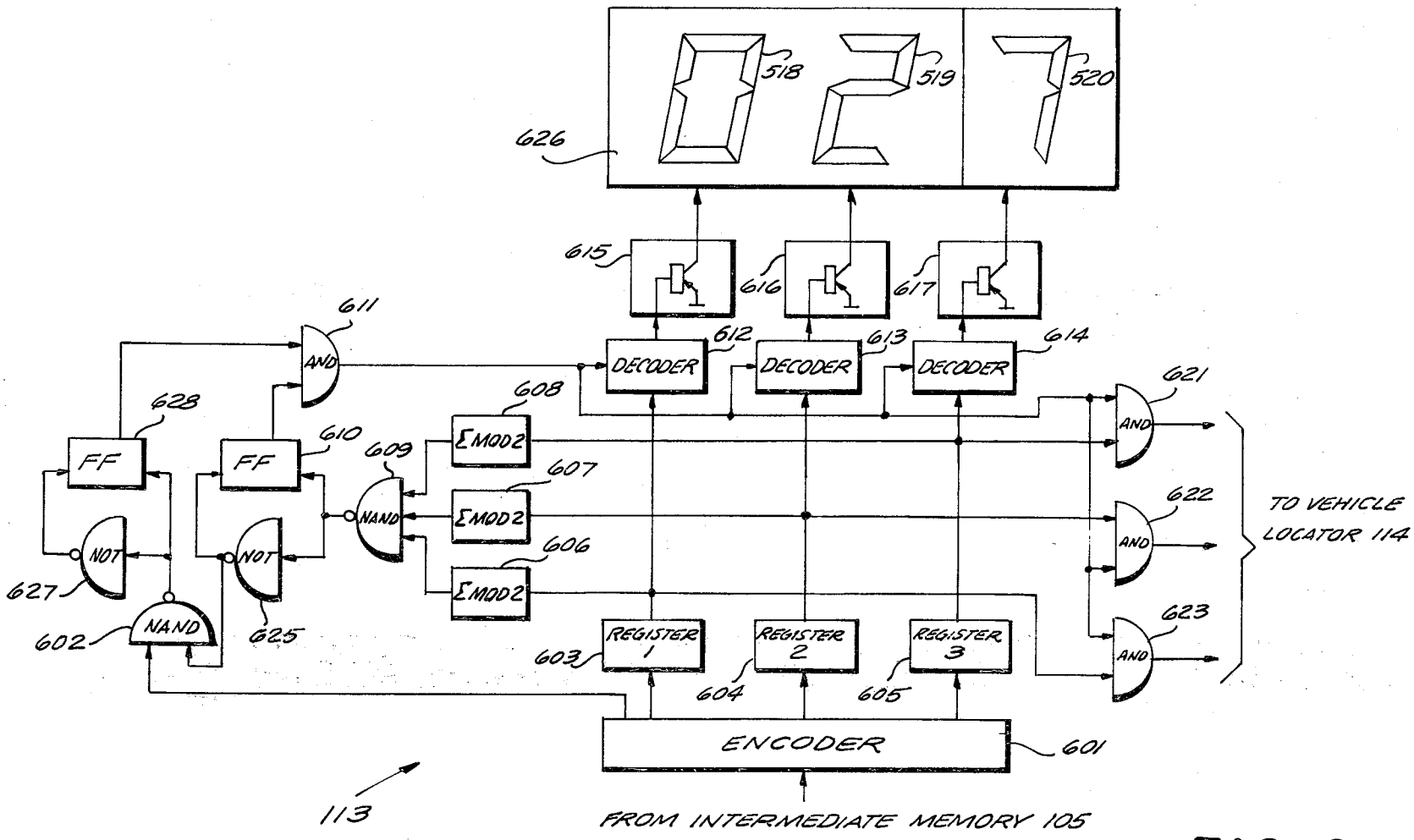
FIG. 6 is a diagram of an address-board unit employed in the system of FIG. 1.

In response to the next instruction from ROM 109, decoders 705 and 515 in FIGS. 7 and 5 energize leads 717 and 509 to transfer the identification code of the first loading station from buffer register 502 and the comparison result from unit 106 into the cell of intermediate memory 105 determined by the address register of that memory as stored in register 712.

It should be noted that a loading station not in operation is indicated by a zero percentage of valuable contents in the respective cell of intermediate memory 105, on the basis of a non-yield entry from keyboard 504. Upon evaluation in arithmetic unit 106, that zero percentage forms a code in network 708 designating an address of a non-working loading station in intermediate memory 105 which prevents any further assignment of transport vehicles to that station.

In an analogous manner all other loading stations are classified into two groups with regard to the quality of the material to be transported.

When the classification cycle is completed, an instruction is given by ROM 109 causing network 708 and decoder 705 to inhibit the stepping of counter 710 by de-energizing one input of AND-gate 709, preparatorily to a manual switchover of network 507 to be communicated to networks 514 and 708. This instruction, as read by decoder 706, results in the de-energization of another input of AND-gate 709, resets counter 710, enables register 719 and unblocks AND-gate 721 while blocking AND-gate 722. Rom 109 now again reads out the contents of its NO. 0 address so that processor 107 is ready for other operations.

SURVEILLANCE OF UNLOADING STATIONS

The sensing elements 117 of FIG. 2, installed at unloading station 281 – 283, detect changes in certain operating parameters, such as the rate of unloaded material, affecting the production process. The changes detected are converted into electrical input signals transmitted to the programmer 100. The data received are entered in intermediate memory 105 by means of the input/output unit 112 which is hand-operated by the keyboard 504 of FIG. 5 in the same manner as described above.

KEEPING TRACK OF THE LOCATION AND THE IDENTITY OF ANY VEHICLE IN SERVICE

Figure 3:
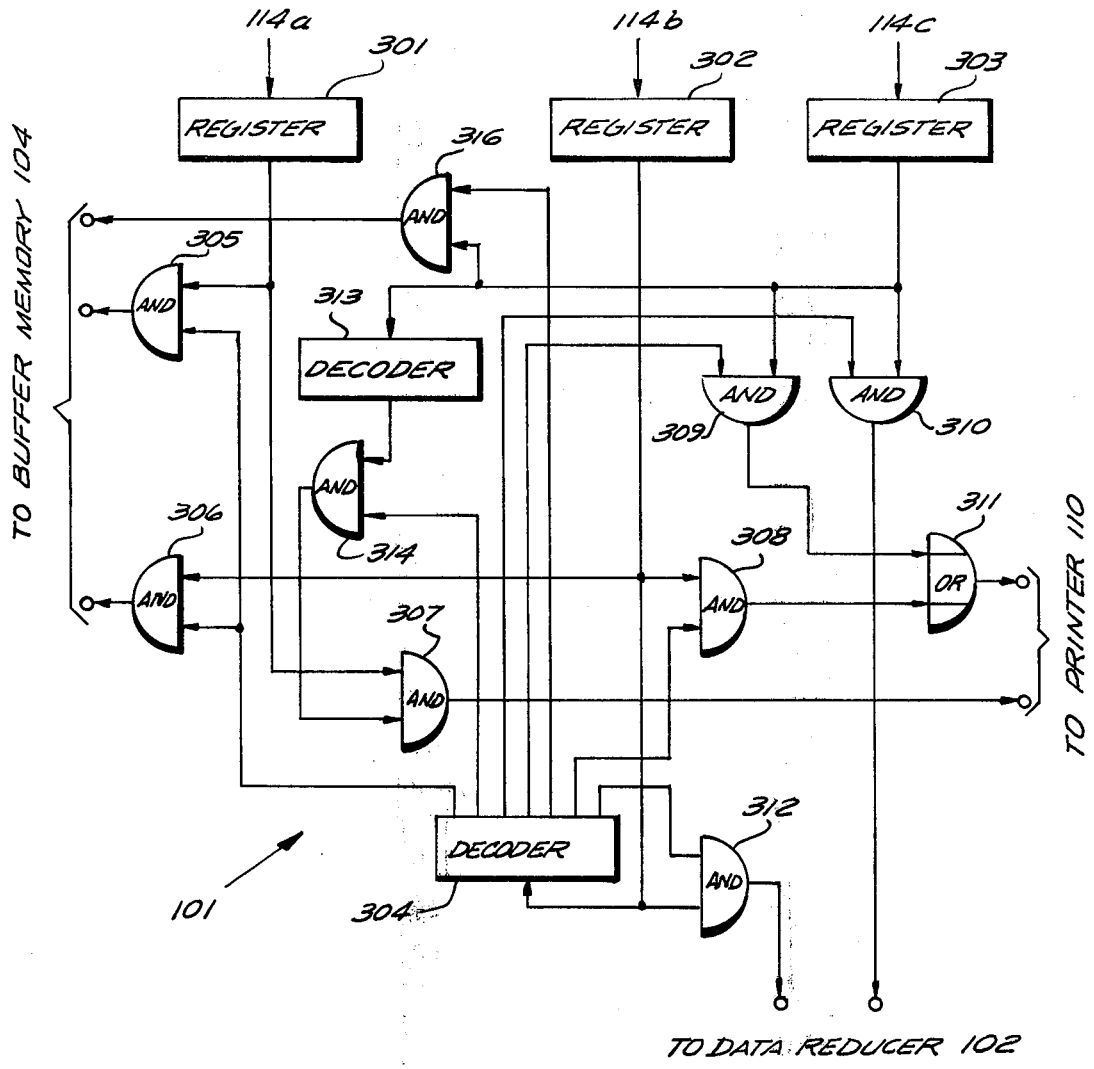
FIG. 3 is a diagram of a data-distribution circuit employed in the system of FIG. 1.
Figure 4:
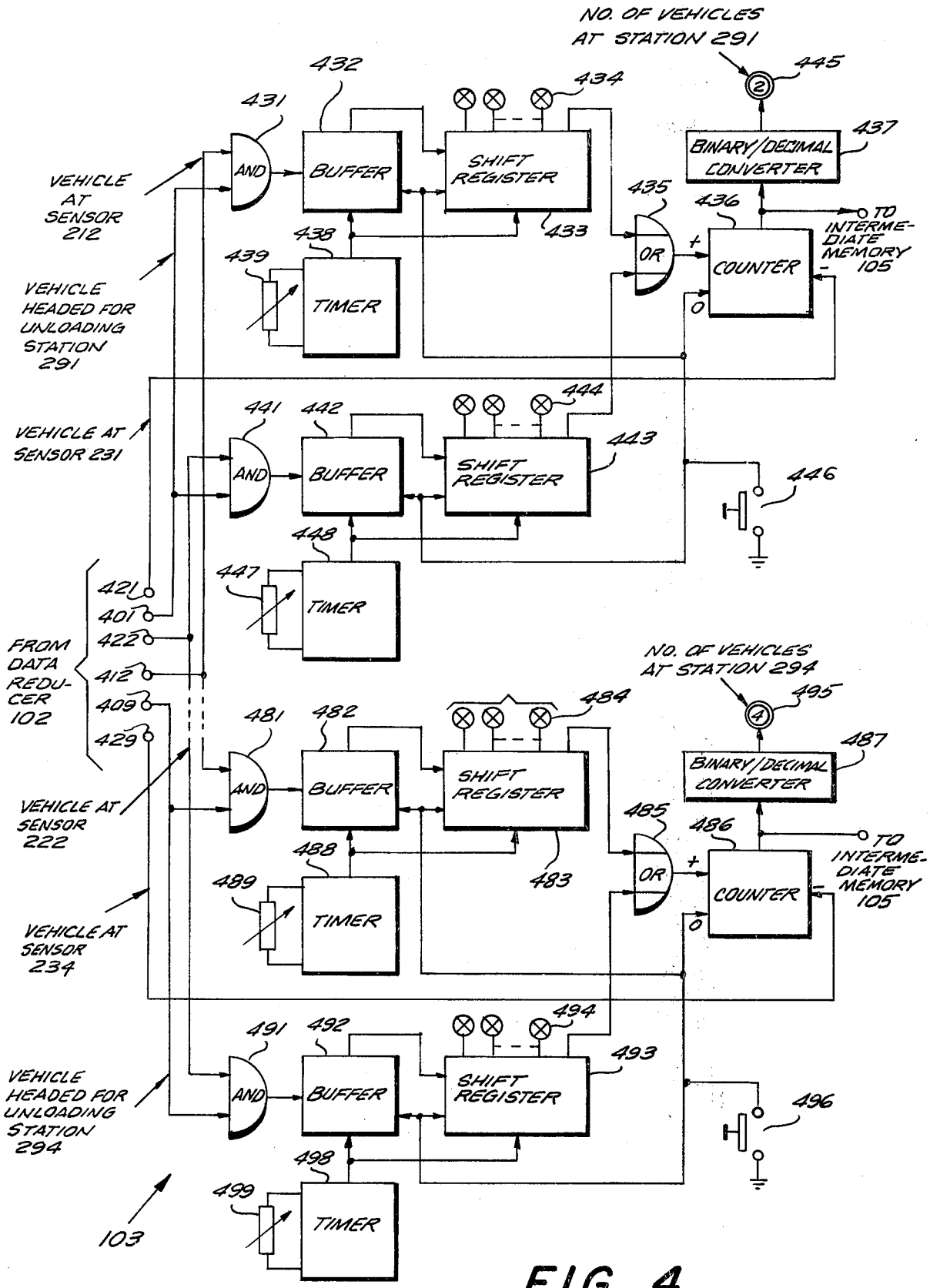
FIG. 4 is a diagram of a traffic-stream simulator and indicator forming part of the system of FIG. 1.

This step is performed by the locator 114 of FIG. 1 including the roadside sensors 211 etc. installed at preselected locations along the various routes and at the various loading stations as shown in FIG. 2. The presence of a vehicle near a sensor is detected by reception of a coded information signal transmitted permanently by that vehicle. Every sensor generates its own coded signal and both codes are passed by the locator 114 to programmer 100, more particularly to distribution circuit 101 thereof. Each one of the three inputs 114*a*, 114*b*, 114*c* of circuit 101, shown in FIGS. 1 and 3, is a conductor multiple with a number of leads corresponding to the nature of the information transmitted. The information arriving from locator 114 is stored in registers 301, 302 and 303 of FIG. 3, each having a number of stages equal to that of its input leads.

The information stored in register 302 controls distribution and represents the code signal of the transmitting sensor. A decoder 304 generates signals for the unblocking of two AND-gates 305 and 306 leading to the buffer memory 104. For example, when a vehicle 265 traveling along route 272 passes the sensor 251, it transmits automatically its identification code to the sensor station, which retransmits it together with its own identification code for storage in the aforementioned registers 301 and 302, respectively. As the second inputs of AND-gates 305 and 306 are respectively connected to registers 301 and 302, both codes are passed to buffer memory 104.

The contents of the No. 0 address of ROM 119 activate the network 708 and its decoder 705 to energize respective inputs of two AND-gates 703 and 704, a second input of gate 704 being energized in the zero state of counter 710 through a decoder 711. When a pulse arrives from clock 111, network 708 energizes the remaining inputs of AND-gates 703 and 704 whose outputs 701 and 702 thereupon enable the transfer of data from buffer memory 104 to a register 707 via bus 501. The identification code of sensor 251 and the accompanying identification code of vehicle 265 produce output signals from decoder 705 which load the register 712 and block the AND-gates 703 and 704. Furthermore, signals arriving from decoder 506 over leads 534 indicate the nonintervention of keyboard 504. Decoder 705 energizes leads 714 and 718 to allow the transfer of the code from register 712 into register 719, via bus 501. The code in register 719 designates a cell address of ROM 109 whose contents prepare network 708 for the next clock pulse and, via decoder 706, enable the subsequent stepping of counter 710. The next pulse from clock 111 advances counter 710 by one step and results in another instruction from ROM 109, causing network 708 and decoder 705 to furnish a group of signals identifying an address of internal memory 105 which contains the information that vehicle 265 has been brought under the control of the system. The next clock pulse results in the energization of leads 714 and 535 in the output of network 708, the signals on leads 535 causing by way of decoder 515 the energization of lead 509, thereby reopening the writing circuit for intermediate memory 105 from bus 501. Another clock pulse brings forth a new instruction from ROM 109 for the transfer of the indentification code of vehicle 265 from register 712 to a corresponding address of intermediate memory 105. The following clock pulse calls out an instruction for the blocking of AND-gates 709 and 722, resetting of counter 710, enablement of register 719 and unblocking of AND-gate 721, all as previously described. ROM 109 passes to zero address and prepares network 708 for other operations.

Analogously, information is received in programmer 100 from any other vehicle moving past a sensor. The identification code of each sensor determines a specific cycle of operations which are performed by processor 107 as a result of instructions in selected cells of ROM 109.

The information concerning the location and identity of each vehicle is received by the operator on a digital display 525 shown in FIG. 5. The information written into buffer memory 104 concerning the identification codes of the vehicle and the sensor are stored in a register 521 upon simultaneous energization of the inputs of an AND-gate 520 by decoders 506 and 515 in response the the detection of the sensor code in network 708 and the resulting energization of certain output leads 535 of decoder 705.

ALLOCATING THE VEHICLES IN SERVICE TO LOADING AND UNLOADING STATIONS

The allocation of destinations to the vehicles serving the several loading and unloading stations is performed by programmer 100 when a vehicle passes the sensor 211 or 221 upon leaving one of the unloading stations 281–283.

When vehicle 261 moves past sensor 211, its identification code and that of the sensor are stored in registers 301 and 302, respectively, as described above. The sensor code controls functions in distribution circuit 101 different from those initiated by the vehicle code. Both codes are entered in buffer memory 104. The cell contents at the No. 0 address of ROM 109 again unblocked AND-gates 703 and 704 to open a path for the transfer of the codes entered in buffer memory 104 into register 707 via bus 501. The sensor code determines an initial address in ROM 109 to be entered in register 719, thereby starting the cycle for a decision to be taken with regard to the assignment of the vehicle 261 here considered. The information needed for this decision is stored in designated cells of intermediate memory 105. The instruction from ROM 109 according to the initial address associated with sensor 211 brings about a sequence of operations similar to those already described. Thus, when a pulse from clock 111 arrives at the stepping input of counter 710, an address is selected in ROM 109 whose instruction causes network 708 and decoder 705 to specify an address in intermediate memory 105 designed for the storage of the identity of the vehicle brought under the control of the system. By the next clock pulse, an instruction is read from ROM 109 allowing the transfer of the data written in register 719 to the address register of intermediate memory 105. The information in the cell of intermediate memory 105 at this address is extracted from the information register thereof by the energization of lead 508 and entered in a register of arithmetic unit 106 by a signal on a lead 716. An instruction commanding a comparison of this information with zero is transmitted to arithmetic unit 106 by network 708 and decoder 705 through register 712, with energization of leads 714 and 715, whereupon counter 710 is arrested. The result of the comparison is fed back to network 708 and causes the reactivation of counter 710 when the cell assigned to vehicle 261 has a content other than zero.

In the case when the above-mentioned cell has a zero content, network, 708 and decoder 705 cause the entry of a zero code in register 712; upon the arrival of the next pulse from clock 11 this zero code is passed to a register 723 for transfer to the address register of ROM 109 via an AND-gate 724 and OR-gate 720. This restores the ROM to its No. 0 reading and the cycle begins again, the vehicle being left uncontrolled.

When, however, the cell of vehicle 261 contains information other than zero, the selection of following instructions continues. First, a cell in intermediate memory 105 is addressed which contains an indication of the total amount of ore produced up to that time. This amount is compared continuously in arithmetic unit 106 with the target quality of ore to be produced during the shift, that quantity having been previously entered in a predetermined cell in intermediate memory 105 by means of keyboard 504. The result of the comparison is stored as a ratio in a designated cell of intermediate memory 105. Another cell then addressed in intermediate memory 105 stores information on the total amount of overburden handled up to that time. That amount is compared in arithmetic unit 106 with the target quantity of overburden to be handled during the shift, the latter quantity having also been previously entered in a specific cell of intermediate memory 105. The result of this comparison is stored again as a ratio in a designated cell of intermediate memory 105. A series of instructions for comparison of both ratios is stored at predetermined addresses of intermediate memory 105.

The instruction for the performance of the comparison operation by arithmetic unit 106 is the last of the cycle for each one of the vehicles prior to its allocation to a station or group of such stations. It not only stops the stepping of counter 710, but also resets that counter in order to begin a new cycle. The result of the comparison is passed from arithmetic unit 106 to network 708.

In case the ore ratio is less than the overburden ratio, network 708 and decoder 705 identify an address in ROM 109 which begins a new cycle of instructions. The ensuing sequence of instructions specifies the addresses in intermediate memory 105 containing stored information concerning their respective outputs up to that time in proportion to their expected output during the shift, as well as information concerning the quality of the material loaded at a given station. Successive comparisons in arithmetic unit 106 of the information concerning the output of each loading station result in a determination of the station having the least relative yield. Unit 106 also determines whether the contribution of that loading station in terms of ore percentage to the planned percentage in the overall output of the system is close to a predetermined value within admissible tolerances. If this is not the case, network 708 and decoder 705 address a cell of intermediate memory 105 containing the code of that loading station. The following instructions of ROM 109, read out upon repetitive stepping of counter 710, establish a new sequence of operations for comparing, within unit 106, the number of vehicles waiting at the loading station with a predetermined maximum admissible number of waiting vehicles. The number of waiting vehicles is visually ascertained from the screen of simulator 103 and is fed via keyboard 504 into the corresponding cells of memory 105. If the number of waiting vehicles at the station considered does not exceed the admissible maximum, a new cycle of instructions is called forth from ROM 109 to determine the unloading station which up to that time has had a minimum relative output productivity, in a manner analogous to the determination of the loading station of least relative yield. When this comparison cycle is completed, the code of that unloading station is introduced at the address of intermediate memory 105 containing the code of the loading station in need of additional transportation. The cycle of ROM 109 initiated by the introduction of the code of sensor 211 ends with a final instruction for the selection of an address in intermediate memory 105 which has been supplied, in the manner just described, with the codes of a loading and an unloading station; by energizing an output lead 527, decoder 506 allows the contents of this cell to be transferred to the address-board unit 113' located near sensor 211.

Furthermore, the code of the chosen loading station is indicated to the keyboard operator on a digital display 523. This code is entered in a register 517 upon the concurrent energization of the two inputs of an AND-gate 516 by decoders 506 and 515 in the presence of predetermined code combinations in networks 507 and 514. The information for address-board unit 113'' is taken from a register 519 upon the energization of the inputs of an AND-gate 518. The digital display 523 is alternately connectable to the outputs of registers 517 and 519, by a switch 522, to let the keyboard operator monitor the directives appearing on either address-board unit.

ROUTING THE VEHICLES BETWEEN SELECTED LOADING AND UNLOADING STATIONS

Address-board units 113' and 113'' shown in FIG. 2 are operated in the following manner: The code of the loading station, provided by intermediate memory 105, is formed in an encoder 601 shown in FIG. 6. It is stored in registers 603 and 604. The code of the unloading station is formed in the same manner and stored in a register 605. An unblocking or de-energizing signal of one of the inputs of a NAND-gate 602 is emitted concurrently by encoder 601. The contents of registers 603, 604 and 605 are checked by module-2 complementation in adders 606, 607 and 608, respectively. If these contents are determined to be correct, the outputs of these adders are all zero so that a NAND-gate 609 conducts to reset a flip-flop 610 and energizes one input of an AND-gate 611. Through an inverter 625 the second input of NAND-gate 602 is also de-energized so that this gate conducts to reset a flip-flop 628 which energizes the second input of AND-gate 611. With AND-gate 611 conducting, three decoders 612, 613 and 614 are enabled to illuminate, by means of respective switching circuits 615, 616 and 617, numerals 618, 619 and 620 on a panel 629. This message directs the driver to proceed to a certain loading station and then to discharge his load at a specific unloading station. AND-gates 621, 622 and 623 are unblocked at the same time so that the result of the decision is passed to the vehicle locator 114 and thence transmitted to the programmer 100 via its output 114c terminating at register 303 of distribution circuit 101. Flip-flops 610 and 628 are respectively settable via inverter 625 and another inverter 627.

The code thus stored in register 303 is read by a decoder 313 which unblocks an AND-gate 314. With the identification codes of vehicle 261 and sensor 212 respectively stored in registers 301 and 302, as described above, decoder 304 enables the transfer of the contents of register 303, representing the information displayed on address board 113', to the buffer memory 104 through an AND-gate 316. Furthermore, decoder 304 energizes the second input of AND-gate 314 enabling the passage of the vehicle-identification code through an AND-gate 307 to the printer 110.

The information displayed on panel 626 of address-board unit 113 and thereby communicated to the vehicle's driver, upon being transmitted to buffer memory 104, is stored in register 707 in response to the preceding instruction from ROM 109, this instruction blocking the stepping of counter 710 until the new information has been transferred to network 708. The cycle for the communication of destination information to the vehicle's driver is completed upon the storage of the vehicle route in a predetermined cell of intermediate memory 105.

PRINTING

While the identification code of the vehicle stored in register 301 is passed through AND-gate 307, decoder 304 also unblocks two AND-gates 308, 309 in cascade with an OR-gate 311 whereby the printer 110 also receives the code of the sensor from register 302 and the routing instructions from register 303. In response to the sensor code, transmitted to processor 107 via buffer register 104, network 708 and decoder 705 call out an instruction from ROM 109 to commence the printing cycle.

SIMULATION AND INDICATION

Detection of the code of the sensor 212, stored in register 302 by decoder 304, causes the unblocking of an AND-gate 312 for the transmission of this code to data reducer 102. Another AND-gate 310 is also opened to pass the contents of register 303 to data reducer 102. The presence of a vehicle-identification code, detected in data reducer 102, results in the energization of a lead 418, FIG. 4, in traffic-stream simulator 103. The code for the vehicle route causes energization of a lead 401 identifying the loading station, here assumed to be station 291, for which the vehicle is headed. The coincidence of these two signals in the inputs of an AND-gate 431 writes a bit "1" in a buffer stage 432. A timer 438 generates pulses whose cadence is adjustable and which cause the transfer of the stored bit from buffer stage 432 and through the several stages of a shift register 433. The pulse rate of timer 438 is so chosen that the transit time of the bit through shift register 433 substantially equals the time needed for the vehicle to travel from sensor 212 to the assigned loading station 291. The progress of the vehicle toward that station is simulated by the successive lighting of a series of lamps 434 connected, through nonillustrated amplifiers, to respective stage outputs of shift register 433. The last stage of this shift register works through an OR-gate 435 into an additive input of a counter 436 so as to increase its count by one. The setting of counter 436 is displayed, upon decoding in a binary/decimal converter 437, on a numerical indicator 445. This count is also transmitted to intermediate memory 105 for storage in certain cells assigned to the number of vehicles waiting at respective loading stations.

When a vehicle passes the other sensor 222 on its way to the same loading station 291 and this information is transmitted to programmer 100, the identity of this sensor as decoded in data reducer 102 gives rise to a signal on a lead 422 so that, in the presence of routing information again energizing the lead 401, a bit is fed to a buffer stage 442 through an AND-gate 441. From there the bit proceeds through another shift register 443 to OR-gate 435 and counter 436, its movement being simulated by the successive lighting of a second series of lamps 444 under the control of another timer 448 with a potentiometer 447. Counter 436, being common to the two simulation circuits for vehicles approaching loading station 291 over different routes, thus registers the total number of vehicles waiting at that loading station in response to directives communicated to their drivers by address boards (113′ and 113″) juxtaposed with sensors 212 and 222, respectively.

CHECKING THE PRESENCE OF A VEHICLE

When, for instance, vehicle 264 is operating at loading station 293, sensing element 233 continuously receives its identification code. This code, together with the code of sensor 233, is transmitted by vehicle locator 114 to the programmer 100 and entered in distribution circuit 101, as described above. The code of sensor 233, present in register 302, is detected by decoder 304 and opens not only the AND-gates 305 and 306, for the read-out of the contents of registers 301 and 302 to buffer memory 104, but also an AND-gate 312 for transmission of the sensor code to data reducer 102. This results in the energization of a lead 421, terminating at a subtractive input of counter 436, so that the count is diminished by one to update the information passed to intermediate memory 105 and displayed by indicator 445.

Buffer stages 432, 442 and shift registers 433, 443 can be cleared manually with the aid of a switch 446, along with counter 436.

Leads 412 and 422 are common to a plurality of simulator units analogous to the one just discussed but assigned to loading stations 292, 293, 294. The last one of these units has also been illustrated, its elements 481 – 489, 491 – 496, 498, 499 respectively corresponding to elements 431 – 439, 441 – 446, 448, 449 of the first unit. Leads 409 and 429 are energized by data reducer 102 upon detection of the codes of station 294 and sensor 234, respectively, accompanied by a vehicular code, as described above.

CHECKING THE ITINERARY

The correctness of the intinerary to be observed is checked constantly. Information concerning the code of any loaded vehicle, and the code of the loading station in which the vehicle was loaded, is stored in register 707 in response to a zero-address instruction from ROM 109. When such an instruction is given and the contents of register 707 are transmitted to the neck 708, decoder 705 loads the register 712 and energizes the leads 714 and 725 to identify a cell address in ROM 109 from which the itinerary-checking cycle begins. The instruction from that cell generates signals allowing the transfer of the contents of register 712 to a register of arithmetic unit 106 by the energization of a lead 713. Upon a stepping of counter 710 by a pulse from clock 111, the following instruction from ROM 109 specifies an address in the intermediate memory 105 where the route of the vehicle leaving that particular loading station is stored. Energization of two output leads 511 and 513 of decoder 515 allows this address to be read out into the information register of data store 108, at an address specified by the contents of register 712. The next clock pulse causes the transfer of the information from the designated cell of intermediate memory 105 to another register of arithmetic unit 106 by the energization of an output lead 716 of decoder 705. The following clock pulse elicits an instruction from ROM 109 for comparing the contents of the two loaded registers of arithmetic unit 106 while arresting the counter 710. If these contents are identical, the code of the previous instruction stored in network 708 and register 712 is modified to specify the address of another cell in data store 108 in which the address of a designated cell of intermediate memory 105 is written as a confirmation code indicating that the vehicle has properly completed its itinerary. When no identity exists between the two codes, the address of another cell is of another cell in data store 108 is specified to receive the address of the cell of memory 105 containing the code of the checked vehicle. The information registered in store 108 can be read out into bus 501 upon the energization of a further output lead 512 of decoder 515.

FINAL PRINT-OUT

A cycle for final printing is initiated by the operator by means of keyboard 504. Upon the selection of a predetermined instruction from ROM 109, information is read off consecutively from all cells of data store 108 to the printer 110. This cycle is terminated by a final instruction from ROM 109.

It will be understood that some of the leads shown in FIGS. 3 – 7 are representative of multiple conductors, with corresponding duplication of the associated logic gates.

The foregoing description of the function of programmer 100 has been limited to the most important steps discussed hereinabove; the performance of ancillary operations, such as the counting of the number of vehicles in service or the mathematical determination of flow density as a parameter to be taken into account in the selection of a loading station, can be carried out with the described equipment in a manner which will be readily apparent to persons skilled in the art.

We claim:

1. A method of rationalizing the operation of an open-pit mine with a plurality of loading stations adjacent respective excavation sites and at least one unloading station at a processing site served by a fleet of vehicles for the transport of excavated material from said loading stations to said unloading station, the excavated material containing high-value and low-value constituents in varying proportions, comprising the steps of a. establishing production quotas for high-value and low-value constituents to be processed during a predetermined operating period;

b. measuring during said operating period, at each excavation site, the relative proportions of high-value and low-value constituents in the excavated material;

c. classifying said loading stations in a high-yield group and a low-yield group on the basis of the measurements carried out in step (b);

d. continuously calculating during said operating period a first and a second ratio representing the amounts of produced high-value and low-value constituents in proportion to their respective production quotas as established in step (a);

e. comparing said first and second ratios with each other; and f. routing available vehicles to said loading stations on the basis of the comparison made in step (e), with preference given to the high-yield group upon said second ratio exceeding said first ratio and to the low-yield group upon said first ratio exceeding said second ratio.

2. A method as defined in claim 1 wherein, with a plurality of processing sites and associated unloading stations, step (d) is performed individually for each unloading station and vehicles are routed thereto from loading stations selected in accordance with step (f).

3. A method as defined in claim 1 wherein step (f) includes a determination of the number of vehicles waiting at each loading station of the preferred group and the routing of additional vehicles to a loading station thereof having less than a predetermined maximum number of vehicles waiting to be loaded.

4. A method as defined in claim 3 wherein the number of waiting vehicles at all loading stations is determined simultaneously with the aid of a traffic simulator.

5. A method as defined in claim 1 wherein step (f) includes visually communicating routing instructions to the drivers of empty vehicles at approaches to road junctions giving access to several of said loading stations.

6. A system for rationalizing the operation of an open-pit mine with a plurality of loading stations adjacent respective excavation sites and at least one unloading station at a processing site served by a fleet of vehicles for the transport of excavated material from said loading stations to said unloading station, the excavated material containing high-value and low-value constituents in varying proportions, comprising:

analyzers at said excavation sites for measuring the proportion of high-value and low-value constituents in the excavated material;

monitoring units on the approaches of said stations responsive to the proximity of a vehicle, said monitoring units being provided with transmitting means for sending out vehicle-identifying codes;

programmed means communicating with said monitoring units for receiving said vehicle-identifying codes together with information on the outputs of said analyzers and data on the arrival rates of high-value and low-value constituents at said unloading station, said programmed means including an arithmetic unit for continuously calculating from said data a first and a second ratio representing the proportions of produced high-value and low-value constituents to respective production quotas therefore, comparing said ratios with each other, comparing the analyzer outputs with a predetermined mean value for classifying said loading stations in a high-yield group and a low-yield group, and generating routing instructions for empty vehicles giving preference to said high-yield group upon said second ratio exceeding said first ratio and to said low-yield group upon said first ratio exceeding said second ratio; and traffic-directing means controlled by said programmed means for supplying said routing instructions to the drivers of empty vehicles, said programmed means including a memory for the storage of origin and destination of each vehicle derived from the received vehicle-identifying codes.

7. A system as defined in claim 6 wherein said traffic-directing means comprises a plurality of address boards positioned on the approaches of road junctions giving access to several of said loading stations.

8. A system as defined in claim 7 wherein said monitoring units include a pair of sensors upstream and downstream of each address board.

9. A system as defined in claim 6, further comprising traffic-simulation means controlled by said programmed means for visually indicating the movement of vehicles routed toward respective loading stations.

10. A system as defined in claim 6 wherein a plurality of processing sites are served by respective unloading stations, further comprising sensing means at each loading and unloading station for signaling the operations thereof to said programmed means.

* * * * *